US010734148B2

(12) United States Patent
Jotter et al.

(10) Patent No.: US 10,734,148 B2
(45) Date of Patent: Aug. 4, 2020

(54) ELECTROMAGNETIC HOLDING MAGNET AND METHOD FOR MANUFACTURING, ELECTROMAGNETIC LOCKING ELEMENT AND USE OF THE SAME

(71) Applicant: Kendrion Kuhnke Automation GmbH, Malente (DE)

(72) Inventors: Mathias Jotter, Eutin (DE); Borgar Pfeiffer, Schwentinental (DE); Bleik Teunis, Gettorf (DE)

(73) Assignee: Kendrion Kuhnke Automation GmbH, Malente (DE)

( * ) Notice: Subject to any disclaimer, the term of this patent is extended or adjusted under 35 U.S.C. 154(b) by 694 days.

(21) Appl. No.: 15/438,944

(22) Filed: Feb. 22, 2017

(65) Prior Publication Data

US 2017/0287611 A1 Oct. 5, 2017

(30) Foreign Application Priority Data

Mar. 31, 2016 (DE) ..... 10 2016 205 329

(51) Int. Cl.

| | |
|---|---|
| ***E05B 47/00*** | (2006.01) |
| ***E05C 19/16*** | (2006.01) |
| ***H01F 7/20*** | (2006.01) |
| ***H01F 7/16*** | (2006.01) |

(Continued)

(52) U.S. Cl.

CPC ..... *H01F 7/20* (2013.01); *E05B 47/0006* (2013.01); *E05B 47/0038* (2013.01); *E05C 19/166* (2013.01); *H01F 7/0263* (2013.01); *H01F 7/04* (2013.01); *H01F 7/1646* (2013.01);

(Continued)

(58) Field of Classification Search

CPC . H01F 7/20; H01F 7/1646; H01F 7/04; H01F 7/0263; H01F 2007/1669; E05C 19/166; E05B 47/0038; E05B 47/0006; E05B 2047/0074

See application file for complete search history.

(56) References Cited

U.S. PATENT DOCUMENTS 4,321,570 A * 3/1982 Tsunefuji ..... H01F 7/1646 335/229
9,968,958 B2 * 5/2018 Guastini ..... B05C 3/125

(Continued)

FOREIGN PATENT DOCUMENTS

| | | |
|---|---|---|
| DE | 1408980 | 5/1969 |
| DE | 3822842 A1 | 1/1990 |
| DE | 4131156 C1 | 4/1993 |

(Continued)

*Primary Examiner* — Kristina R Fulton
*Assistant Examiner* — Thomas L Neubauer
(74) *Attorney, Agent, or Firm* — Rankin, Hill & Clark LLP

(57) ABSTRACT

An electromagnetic holding magnet and a method for manufacturing the same, and an electromagnetic locking element that, that in a preferred embodiment, is a lock in a container of an oxygen emergency supply system of an aircraft. The electromagnetic holding magnet includes a yoke and a retaining plate interacting with the yoke as an anchor. At least one permanent magnet generates a magnetic retaining flux in the yoke that includes a first yoke leg and a second yoke leg as well as a middle pole. The middle pole is surrounded in sections by a magnetic coil. The first and second yoke legs are arranged symmetrically in relation to the middle pole and the magnetic coil.

13 Claims, 5 Drawing Sheets

(51) Int. Cl.
*H01F 7/02* (2006.01)
*H01F 7/04* (2006.01)

(52) U.S. Cl.
CPC ..... *E05B 2047/0074* (2013.01); *H01F 2007/1669* (2013.01)

(56) References Cited

U.S. PATENT DOCUMENTS

2013/0135067 A1* 5/2013 Choi ..... B23Q 3/1543 335/290
2015/0279541 A1 10/2015 Choi

FOREIGN PATENT DOCUMENTS

| | | | |
|---|---|---|---|
| DE | 19928622 | A1 | 12/2000 |
| DE | 202006009716 | U1 | 8/2006 |
| DE | 102007047537 | A1 | 4/2009 |
| EP | 1843375 | A1 | 10/2007 |
| EP | 2312605 | A1 | 4/2011 |
| FR | 2948228 | A1 | 1/2011 |

* cited by examiner

ELECTROMAGNETIC HOLDING MAGNET AND METHOD FOR MANUFACTURING, ELECTROMAGNETIC LOCKING ELEMENT AND USE OF THE SAME

PRIORITY

This application claims priority to DE 10 2016 205 329.9, filed Mar. 31, 2016.

BACKGROUND OF INVENTION

Field of Invention

The invention relates to an electromagnetic holding magnet comprising a yoke, a retaining plate that interacts with the yoke as an anchor, at least one permanent magnet, and a magnetic coil that encloses the yoke in sections, wherein in an energized state, the magnetic coil is configured to at least reduce a magnetic retaining flux generated by the permanent magnet in the yoke and the retaining plate in order to at least reduce or eliminate a retaining force generated by the permanent magnet and release the anchor. Moreover, the invention relates to an electromagnetic locking element comprising a base element, an opening element that can move relative to the base element and an electromagnetic holding magnet. In addition, the invention relates to the use of such an electromagnetic locking element. Furthermore, the invention relates to a method for manufacturing an electromagnetic holding magnet comprising a yoke, a retaining plate that interacts with the yoke as an anchor, at least one permanent magnet, and a magnetic coil that encloses the yoke in sections, wherein in an energized state, the magnetic coil is configured to at least reduce a magnetic retaining flux generated by the permanent magnet in the yoke and the retaining plate in order to at least reduce or eliminate a retaining force generated by the permanent magnet and release the anchor.

Brief Description of Related Art

Electromagnetic holding magnets are for example used in locking devices. Such an electromagnetic holding magnet is for example described in DE 41 31 156 A1. The locking device is used in a container that comprises a door that can pivot on a hinge, and accommodates an oxygen emergency supply system in its interior. Such containers are used in aircraft, for example in commercial aircraft.

Known locking devices consist of an electromagnet and a parallel-connected permanent magnet, as well as a rotatably-mounted rocker arm. On the one hand, the rocker arm is held by the permanent magnet in a horizontal locked position and thereby for its part holds a tubular locking piston in a closed position. By means of a spring, the locking piston presses against a ball cage that holds the balls located therein in a form fit in an undercut of a coupling pin. The coupling pin is connected to the pivotable door as a locking part. To open the door, for example when activating the oxygen emergency supply system, the electromagnet of the locking device is excited so that the retaining force generated by the permanent magnet is eliminated or at least reduced. The locking lever then releases from the pole shoes of the permanent magnet, is moved by a spring into an open position and releases the locking piston. The balls disengage from the coupling pin, and the door of the container is unlocked and swings open.

Known electromagnetic holding magnets that are widely used in the described locking device have an asymmetrical design and correspondingly a field distribution that is asymmetrical. To trigger such a retaining device, relatively high currents in the switching coil of the electromagnet are needed in order to effectively compensate for the magnetic retaining force of the permanent magnet. The required triggering output of the locking device, or respectively the electromagnetic holding magnet is therefore relatively high.

Moreover, a complex shape of the electromagnetic holding magnet components, in particular the yoke, is frequently required for the design of the electromagnetic holding magnets in such known locking devices. On the one hand, this requires a large number of assembly and production steps and, on the other hand, regular reworking of different components during the production process.

BRIEF SUMMARY OF THE INVENTION

It is an object of the invention to provide an electromagnetic holding magnet, an electromagnetic locking element, the use of an electromagnetic locking element, and a method to manufacture an electromagnetic holding magnet, wherein the electromagnetic holding magnet, or respectively the electromagnetic locking element, is switchable with less power and moreover is simply designed.

The object is solved by an electromagnetic holding magnet comprising a yoke, a retaining plate interacting with the yoke as an anchor, at least one permanent magnet and a magnetic coil that encloses the yoke in sections, wherein the magnetic coil is configured in an energized state to at least reduce a magnetic retaining flux generated by the permanent magnet in the yoke and the retaining plate in order to at least reduce or eliminate a retaining force generated by the permanent magnet and release the retaining plate, wherein the electromagnetic holding magnet is further enhanced in that the yoke comprises a first yoke leg, a second yoke leg and a middle pole, wherein the yoke legs each conduct a partial flow of the magnetic retaining flux and are arranged symmetrically in relation to the middle pole and the magnetic coil that at least partially surrounds it.

According to aspects of the invention, the electromagnetic holding magnet is designed symmetrically in relation to the magnetic flux guide. Advantageously, the triggering output of the magnetic retaining devices is reduced or respectively minimized by this symmetrical design. In other words, a lower current is required for exciting the magnetic coil so that the magnetic flux generated thereby compensates for the magnetic flux of the least one permanent magnet. The magnetic retaining flux is reduced by the magnetic coil until a spring coupled in particular to the retaining plate is able to lift it off the yoke. For this purpose, it may not be necessary to completely compensate the magnetic retaining flux. In particular however, it is also provided that the magnetic retaining flux is completely compensated by the magnetic field generated by the magnetic coil. Conventional electromagnetic holding magnets frequently only comprise a single permanent magnet for reasons of cost. However, this leads to an asymmetrical design, in particular of the yoke, and a corresponding asymmetrical magnetic field distribution within the yoke. The compensation of such a symmetrical magnetic retaining flux during the triggering process requires high triggering output. This disadvantage is eliminated by the symmetrical design of the electromagnetic holding magnet.

In the yoke of the electromagnetic holding magnet, the magnetic retaining flux flows in the central middle pole toward the retaining plate, enters it, and branches into two separate magnetic partial fluxes that flow through the first yoke leg, or respectively the second yoke leg. When the magnetic pole at least partially surrounding the middle pole is energized, this reduces the magnetic retaining flux in the central middle pole or causes it to completely cease. However, the magnetic retaining flux is at least reduced enough for the retaining force generated by the permanent magnet to be reduced or even completely eliminated. The retaining plate acting as an anchor is released. Due to the symmetrical field distribution, less current, or respectively trigger current, is needed in comparison with conventional electromagnetic holding magnets with an asymmetrical design to sufficiently reduce the retaining flux in the middle pole by means of the magnetic coil to release the retaining plate.

Moreover according to an advantageous embodiment, the first yoke leg, the second yoke leg, the middle pole and the retaining plate consist of flat parts. In particular, a magnetic bypass that will be explained below in detail is manufactured from flat parts, or respectively consists of them. The flat parts are preferably manufactured from pre-annealed corrosion-resistant or stainless sheet metal.

According to a preferred embodiment, the electromagnetic holding magnet is constructed, or respectively manufactured, exclusively from flat parts, at least with regard to the aforementioned components. The flat parts are preferably stamped flat parts. Complex shaping while stamping, the bending of small radii and finishing the stamped parts including subsequent difficult assembly can be advantageously dispensed with.

Since the flat parts are manufactured in particular from pre-annealed corrosion-resistant or stainless sheet metal, it is possible to dispense with finishing, in particular the subsequent magnetic soft annealing of the individual parts and the associated finishing processes that are required, such as an aligning process. Likewise, it is unnecessary to apply surface protection on the sheets.

It is particularly advantageous when, according to another embodiment, the first end face of the first yoke leg, the second end face of the second yoke leg and the central end face of the middle pole are polished surfaces. Since the end faces are polished, it manufactures a necessary flatness to these end faces. In other words, the first end face, the second end face and the central end face extend in a common plane after polishing. It is moreover possible to dispense with the surfaces that are often conventionally used. These always require a small necessary air gap between the retaining plate abutting the end faces and the end faces of the yoke, which yields a reduction of the magnetic force acting on the retaining plate.

Preferably, the unpolished sheet metal parts of the magnetic retaining device are robustly arranged in an installation process with a relatively large tolerance and then secured with a curable substance (such as plastic resin) by casting. In the subsequent polishing process, the sheet-metal blanks of the magnetic retaining device are given a flat end face with very high precision. Alternatively, the polished individual parts can be positioned or aligned in a device and then secured, for example by being cast with a plastic resin. In the latter case, a material can also be used that differs from the aforementioned materials, for example that is not stainless or corrosion-resistant. A surface coating is then provided as protection for the polished surfaces.

According to another advantageous embodiment, the electromagnetic holding magnet is enhanced in that:

a) the first and second yoke leg are flat, wherein the middle pole is arranged centrally between the first yoke leg and the second yoke leg, the first yoke leg, the second yoke leg and the middle pole each comprise a first and opposing second end, and a first end face comprised by the first end of the first yoke leg, a second end face comprised by the first end of the second yoke leg, and a central end face comprised by the first end of the middle pole jointly form a contact surface for the retaining plate, b) the magnetic coil surrounds the middle pole between its first end and its second end in sections, and c) a first permanent magnet is arranged between the second end of the first yoke leg and the second end of the middle pole, and a second permanent magnet is arranged between the second end of the second yoke leg and the second end of the middle pole.

In particular, it is provided that the first permanent magnet and the second permanent magnet are oppositely polarized. In other words, the north-south directions of the two permanent magnets are arranged opposite each other. The symmetrical magnetic retaining flux in the yoke is generated by the opposing arrangement of the two permanent magnets. The required expense of the additional (second) magnet in comparison to conventional systems is overcompensated by the lower production cost of the yoke and coil. The yoke is advantageously manufactured exclusively from flat parts which is very economical; the dimensions of the coil can be smaller due to the lower current strength needed for triggering.

The electromagnetic holding magnet is further enhanced in that it comprises a magnetic bypass that extends between the second end of the first yoke leg and second end of the middle pole, and between the second end of the second yoke leg and the second end of the middle pole.

The magnetic bypass further reduces the necessary triggering output for the triggering process. In other words, the current strength necessary to energize the magnetic coil that is required to reduce the electromagnetic retaining flux sufficiently to release the retaining plate functioning as an anchor is further reduced. In particular, the magnetic retaining flux branches into the magnetic bypass and does not run through the retaining plate.

According to an advantageous development, the magnetic bypass is securely connected to the second end of the middle pole, and a first air gap is provided between the second end of the first yoke leg and a first end face of the bypass facing the second end of the first yoke leg, and a second air gap is provided between the second end of the second yoke leg and a second end face of the bypass facing the second end of the second yoke leg. The provided air gaps ensure that the magnetic retaining flux does not branch into the magnetic bypass without the magnetic coil being activated. The bypass air gap can be provided not only between the bypass and the yoke legs, but also alternatively between the bypass and the middle pole of the yoke.

Preferably, the first end face of the first yoke leg, the second end face of the second yoke leg and the central end face of the middle pole lie in a common plane. This necessary flatness is preferably brought about by polishing the relevant end faces smooth. The top side of the magnetic pole preferably lies below the end face of the middle pole. The coil therefore maintains a predetermined minimum distance from the plane in which the retaining plate functioning as an anchor abuts the cited end faces.

The electromagnetic holding magnet, in particular its yoke and retaining plate, moreover in particular the first yoke leg, the second yoke leg and the middle pole, likewise the bypass, are preferably made exclusively of flat parts. In particular, the flat parts are moreover stamped from sheet metal. Type 1.4016 sheet steel, for example, is suitable.

The middle pole is in particular L-shaped, wherein the long leg extends through the coil. The short leg is in particular part of the second end of the middle pole. The permanent magnets are in contact with the short leg. The bypass is in particular U-shaped. The second end of the middle hole is accommodated by the U.

The object is moreover achieved by an electromagnetic locking element comprising a base element, an opening element that can move relative to the base element and an electromagnetic holding magnet according to one or more of the aforementioned aspects. The electromagnetic locking element is enhanced in that the base body comprises the yoke, the at least one permanent magnet and the magnetic coil, and the opening body comprises the retaining plate, wherein in an energized state, the magnetic coil is configured to at least reduce a magnetic retaining flux generated by the permanent magnet in the yoke and the retaining plate in order to at least reduce or eliminate a retaining force generated by the permanent magnet and release the retaining plate.

The electromagnetic locking element is distinguished by reduced triggering output. At the same time, it is easy and cost-effective to manufacture since, apart from the permanent magnet and coil, only flat parts are used to manufacture the electromagnetic holding magnet comprising the electromagnetic locking element.

Furthermore, the object is achieved by an advantageous use of the electromagnetic locking element as a lock in a container for an oxygen emergency supply system of an aircraft.

The necessary low triggering output of the electromagnetic holding magnet is particularly advantageous for the container of the oxygen emergency supply system of an aircraft. In an aircraft, a large number of such containers are provided so that even small triggering outputs add up to a significant overall output. To minimize this, including in large aircraft, a low triggering output of the individual unit is particularly important.

The object is moreover achieved by a method for manufacturing an electromagnetic holding magnet comprising a yoke, a retaining plate that interacts with the yoke as an anchor, at least one permanent magnet, and a magnetic coil that encloses the yoke in sections, wherein in an energized state, the magnetic coil is configured to at least reduce a magnetic retaining flux generated by the permanent magnet in the yoke and the retaining plate in order to at least reduce or eliminate a retaining force generated by the permanent magnet and release the retaining plate, wherein the method is further enhanced in that it comprises the following steps:

arranging flat parts to manufacture a yoke with a first yoke leg, a second yoke leg, and a middle pole; and arranging the magnetic coil such that it at least partially surrounds the middle pole, wherein the yoke legs each conduct a partial flux of the magnetic retaining flux and are arranged symmetrically relative to the middle pole and the magnetic coil that at least partially surround it.

The production of the electromagnetic holding magnet from flat parts enables a highly efficient production process. High-quality electromagnetic holding magnets can be manufactured with less technical effort. Involved finishing steps can be discarded. Furthermore, the same or similar advantages apply to the method according to aspects of the invention which were already mentioned with regard to the electromagnetic holding magnet itself, and repetitions will therefore be dispensed with.

The method is in particular further enhanced in that the flat parts are manufactured from a pre-annealed, corrosion-resistant and stainless sheet metal, in particular stamped, before they are arranged.

According to another advantageous embodiment, the method is further enhanced in that it comprises the following steps:

a) arranging flat parts to manufacture a first flat yoke leg, b) arranging flat parts to manufacture a second flat yoke leg, and c) arranging flat parts to manufacture a middle pole, wherein the first yoke leg, the second yoke leg and the middle pole each comprise a first and opposing second end, d) arranging the middle pole centrally between the first yoke leg and second yoke leg such that a first end face comprised by the first end of the first yoke leg, a second end face comprised by the first end of the second yoke leg, and a central end face comprised by the first end of the middle pole jointly form a contact surface for the retaining plate, e) securing the yoke legs and middle pole, f) arranging a first permanent magnet between the second end of the first yoke leg and the second end of the middle pole, and arranging a second permanent magnet between the second end of the second yoke leg and the second end of the middle pole, g) arranging the magnetic coil on the middle pole between its first end and second end so that the magnetic coil surrounds the middle pole in sections.

The flat parts are fixed, for example, by casting the flat parts in a curing substance such as a plastic resin.

Furthermore, the method is enhanced in that the first end face, the second end face and the central end face are polished smooth to provide a flat contact surface for the retaining plate.

Polishing the end faces manufactures a necessary flatness so that the retaining plate can be held with a minimum gap against the end faces and therefore with a high retaining force. The polishing is preferably carried out on a fixed yoke. The end faces are therefore preferably polished smooth together in a single step. It is likewise possible to first polish the sheet metal plates smooth, then stack, align and subsequently secure them.

Moreover, the method is further enhanced in that the flat parts are arranged to manufacture a magnetic bypass and in particular fixed, and the magnetic bypass is arranged between the second end of the first yoke leg and the second end of the middle pole, and between the second end of the second yoke leg and the second end of the middle pole, wherein in particular the magnetic bypass is securely connected to the second end of the middle pole, and a first air gap is provided between the second end of the first yoke leg and a first end face of the bypass facing the second end of the first yoke leg, and a second air gap is provided between the second end of the second yoke leg and a second end face of the bypass facing the second end of the second yoke leg.

Further aspects of the invention will become apparent from the description of embodiments according to the invention together with the claims and the included drawings. Embodiments according to the invention can fulfill individual characteristics or a combination of several characteristics.

BRIEF DESCRIPTION OF THE DRAWINGS

The invention is described below, without restricting the general idea of the invention, based on exemplary embodiments in reference to the drawings, wherein we expressly refer to the drawings with regard to the disclosure of all details according to the invention that are not explained in greater detail in the text. In the following.

In the drawings, the same or similar types of elements and/or parts are provided with the same reference numbers so that a reintroduction is omitted.

DETAILED DESCRIPTION OF THE INVENTION

Figure 1:
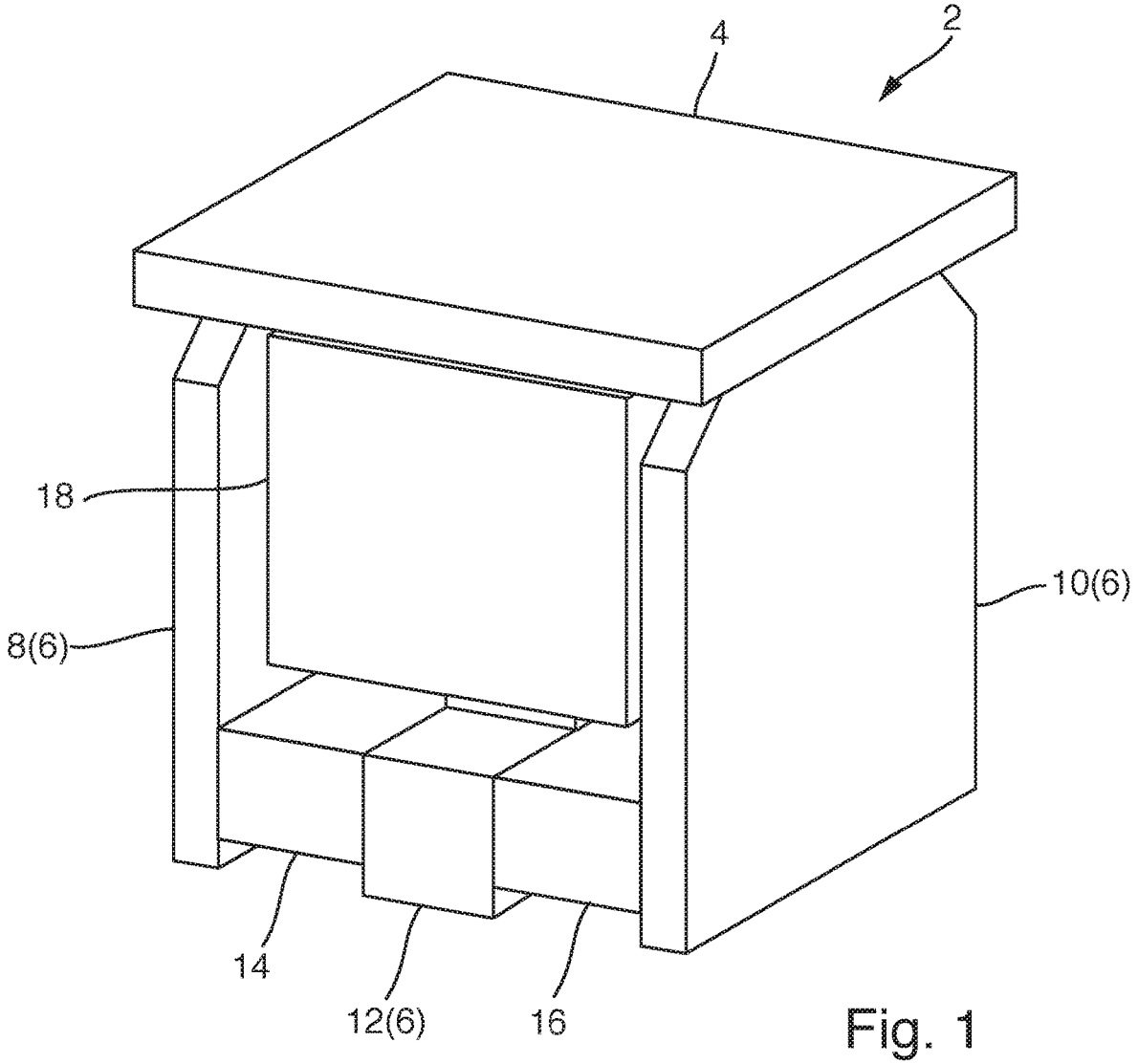
FIG. 1 shows an electromagnetic holding magnet in a schematically simplified perspective representation.

FIG. 1 shows an electromagnetic holding magnet 2 in a schematically simplified perspective representation. The electromagnetic holding magnet 2 comprises a retaining plate 4 that interacts as an anchor with a yoke 6. The yoke 6 comprises a first yoke leg 8, a second yoke leg 10 and a middle pole 12. The retaining plate 4, the first yoke leg 8, the second yoke leg 10 and the middle pole 12 are preferably manufactured from flat parts. These flat parts are preferably stamped parts. They are moreover preferably stamped from pre-annealed, corrosion-resistant or stainless sheet metal.

The electromagnetic holding magnet 2 furthermore comprises a first permanent magnet 14, a second permanent magnet 16 and a magnetic coil 18. The permanent magnets 14, 16 generate a magnetic retaining flux in the yoke 6 and the retaining plate 4 that holds the retaining plate 4 against the yoke 6. In an energized state, the magnetic coil 18 is configured to reduce this magnetic retaining flux generated by the permanent magnets 14, 16 at least sufficiently or even entirely so that a retaining force acting on the retaining plate 4 is at least sufficiently reduced or eliminated so that the retaining plate 4 is released.

If the electromagnetic holding magnet 2 is for example integrated in an electromagnetic locking element, it comprises for example a base element and an opening element that can be moved relative to this base element. The electromagnetic locking element is used for example as a lock in a container of an oxygen emergency supply system of an aircraft. Such a container and a corresponding locking element are for example known from DE 41 31 156 C1, whose content is fully incorporated by reference in the present description.

The base element is for example the container shown in this document in FIG. 1; the opening element that can be moved relative thereto is for example the pivotable door shown in the same figure. In particular, the opening element is pre-tensioned relative to the base element by means of a spring in the opening direction of the opening element. The selected flow to be generated by the magnetic coil 18 that compensates the magnetic retaining flux of the permanent magnets 14, 16 must be large enough so that the retaining force on the retaining plate 4 is reduced enough for such a spring to be able to open the opening element, i.e., a door, for example. Of course, it is also provided for the magnetic retaining flux to be compensated enough so that no retaining force acts on the retaining plate 4.

If the electromagnetic locking element is for example integrated in a container of the oxygen emergency supply system of an aircraft, the base body, i.e., for example the container, comprises the yoke 6, the permanent magnets 14, 16 and the magnetic coil 18. The opening body, i.e., for example the door, comprises the retaining plate 4. In an energized state, i.e., when a triggering current is applied to it, the magnetic coil 18 is configured to reduce the magnetic retaining flux generated by the permanent magnets 14, 16 in the yoke 6 and the retaining plate 4 sufficiently to reduce the retaining force generated by the permanent magnets 14, 16 so that the retaining plate 4 and accordingly for example the door are released. Such a process occurs for example when the oxygen emergency supply system in an aircraft is triggered.

The electromagnetic holding magnet 2 is distinguished by a particularly low triggering output. This is achieved by the symmetrical design of the electromagnetic holding magnet 2. The yoke legs 8, 10 each conduct a partial flux of the magnetic retaining flux generated by the permanent magnets 14, 16 and are arranged symmetrically relative to the middle pole 12 and the magnetic coil 18 that at least partially surrounds it.

Figure 2:
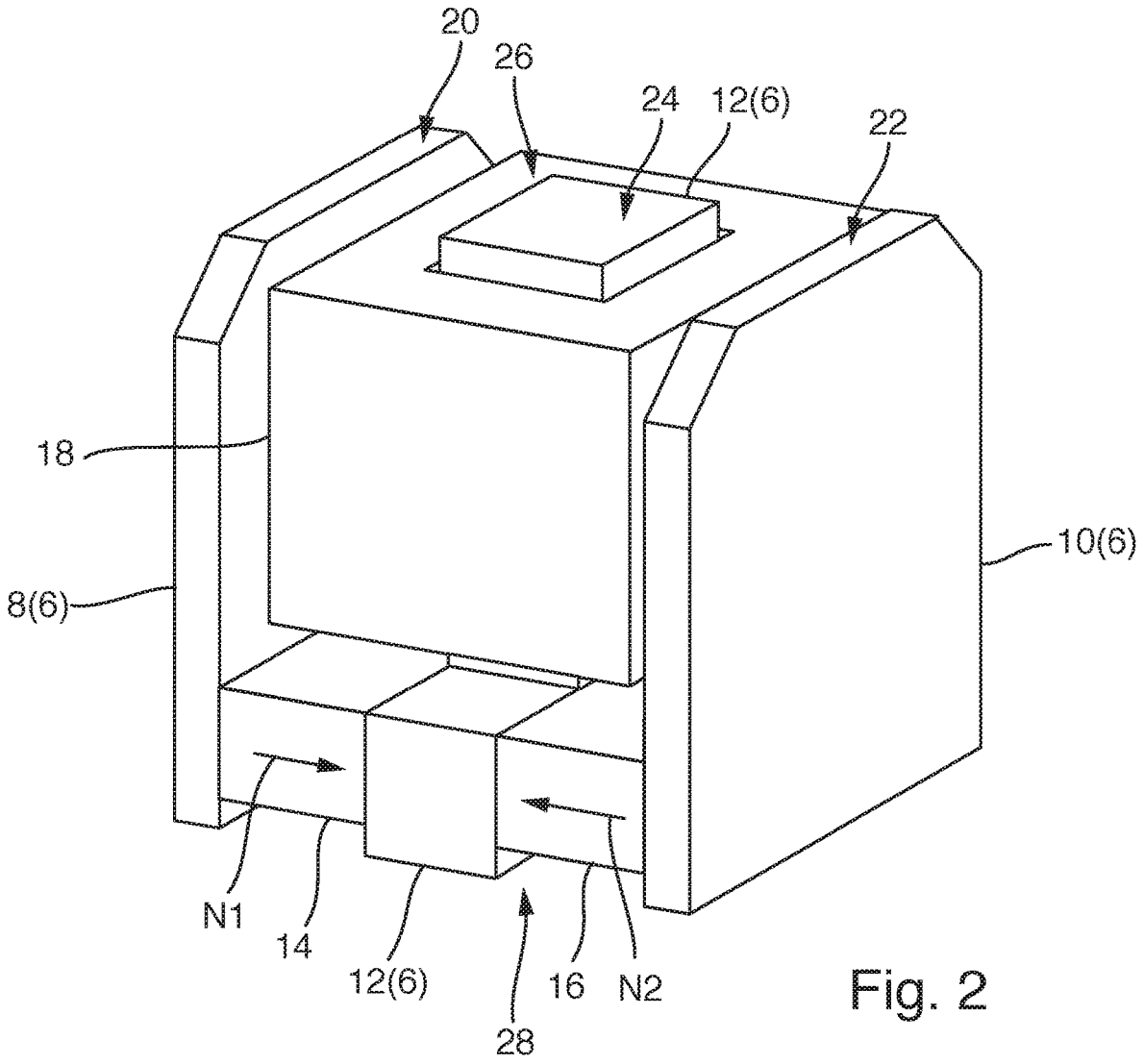
FIG. 2 shows the electromagnetic holding magnet in a simplified perspective representation, wherein the retaining plate is not shown.

FIG. 2 shows the electromagnetic holding magnet 2 from FIG. 1 in a simplified perspective representation, wherein in contrast to FIG. 1, the retaining plate 4 is not shown.

The first yoke leg 8 and the second yoke leg 10 are flat components. As already mentioned, they are manufactured from flat parts, such as sheet metal plates stacked on each other. The middle pole 12 is arranged centrally between the first yoke leg 8 and the second yoke leg 10. The first yoke leg 8 and the second yoke leg 10 as well as the middle pole 12 each have a first and opposing second end. A first end face 20 comprised by the first end of the first yoke leg 8, a second end face 22 comprised by the first end of the second yoke leg 10, and a central end face 24 comprised by the first end of the middle pole 12 jointly form a contact surface for the retaining plate 4. In order to manufacture a necessary flatness for the end faces 20, 22, 24, these faces are preferably polished surfaces. To this end, for example the flat parts from which the first yoke leg 6, the second yoke leg 10 and the middle pole 12 are constructed are aligned and secured. Then the components are polished together. Alternatively, the flat parts are first polished and then positioned and secured. To protect the polished surfaces, a surface can be provided, or respectively applied in this case.

The magnetic coil 18 surrounds a part of the yoke 6 in sections. The magnetic coil 18 is in fact arranged on the middle pole 12 that penetrates the center of the middle pole. In other words, the magnetic coil 18 surrounds the middle pole 12 between its first end 26 and its second end 28 (see FIG. 5 which will be discussed in greater detail below).

The first permanent magnet 14 is arranged between the second end of the first yoke leg 8 and the second end 28 of the middle pole 12. The second permanent magnet 16 is arranged between the second end 28 of the second yoke leg 10 and the second end 28 of the middle pole 12. For the definition of the first and second end of the yoke legs 8, 10, the same orientation applies as for the first and second end 26, 28 of the middle pole 12. In FIG. 2, the first ends of the yoke legs 8, 10 as well as the first end 26 of the middle pole 12 lie at the top, whereas the second ends, as well as the second end 28 of the middle pole 12, lie at the bottom.

The first permanent magnet 14 and the second permanent magnet 16 are oppositely polarized. They accordingly have opposing north-south directions N1, N2 that for example are indicated with arrows in FIG. 2. In this context, N1 designates the north-south direction of the first permanent magnet 14, and N2 designates the north-south direction of the second permanent magnet 16. The magnetic north pole of the permanent magnets 14, 16 lies for example in the direction of the arrow.

The permanent magnets 14, 16 generate a magnetic retaining flux that enters the middle pole 12 at the second end 28. The magnetic retaining flux flows into the middle pole 12 in the direction of its first end 26, i.e., through the magnetic coil 18. The magnetic retaining flux enters the retaining plate 4 at the central end face 24. It branches into the retaining plate in the direction of the first yoke leg 8 and in the direction of the second yoke leg 10. These two partial fluxes of the magnetic retaining flux flow sideways into the retaining plate 4 in the direction of the first end face 20 of the first yoke leg 8, or respectively in the direction of the second end face 22 of the second yoke leg 10. A first partial flux enters the first yoke leg 8 at the first end face 20 and flows in the first yoke leg in the direction of its second end. It thereby ultimately returns to the first permanent magnet 14. Analogously, the second partial flux enters the second yoke leg 10 at the second end face 22 and also flows in the direction of its second end. At that location, it returns to the second permanent magnet 16. If the magnetic coil 18 is energized, a magnetic flux is generated in the middle pole 12 in the region surrounded by the magnetic coil 18 that runs counter to the retaining flux as described above. The retaining flux is therefore diverted into a bottom region of the yoke 6. In the vertical part of the middle pole 12 in FIG. 2, the magnetic retaining flux is at least largely suppressed. Accordingly the retaining force generated by the permanent magnets 14, 16 on the retaining plate 4 is compensated, and the retaining plate 4 is released.

Figure 3:
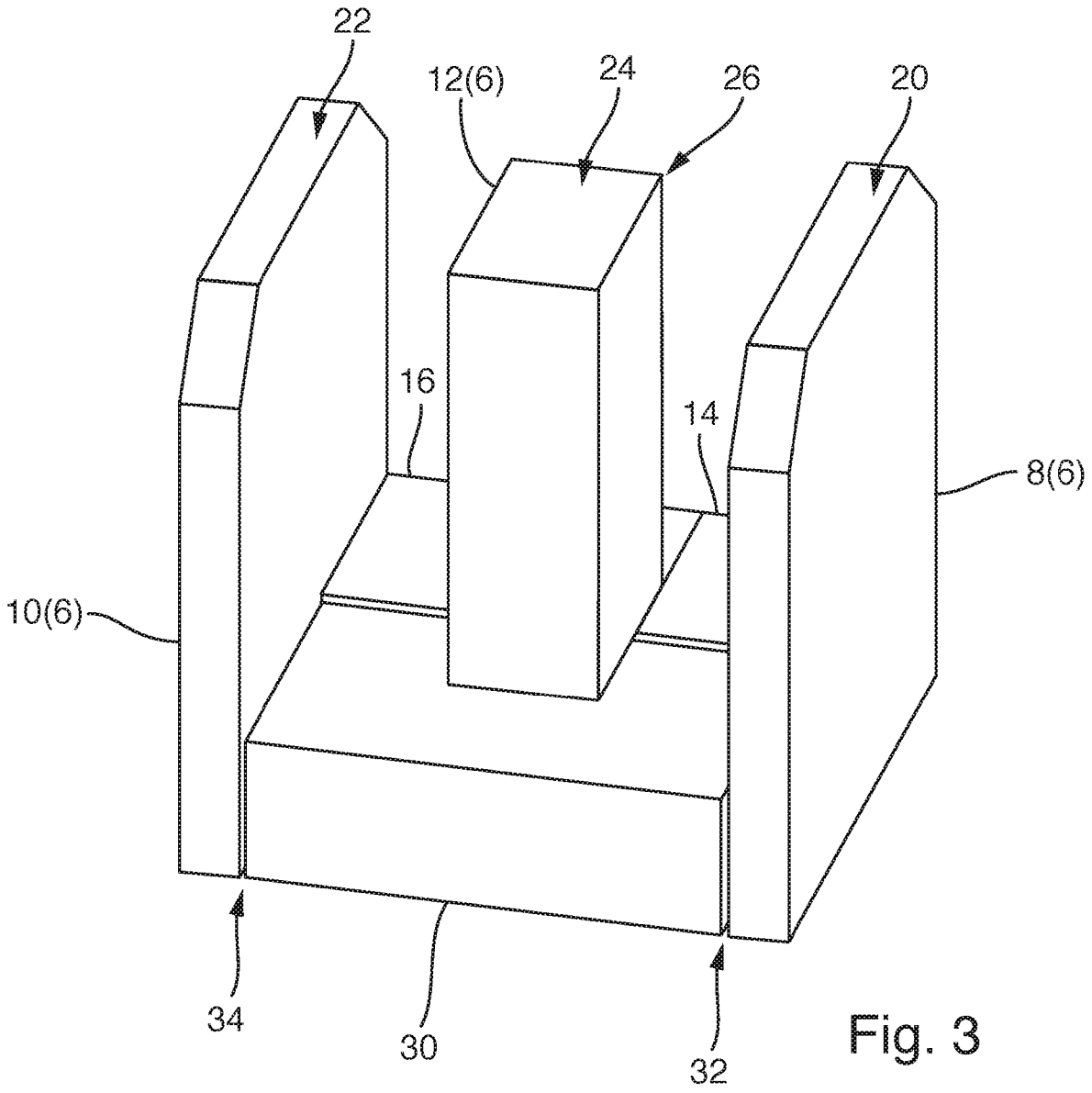
FIG. 3 shows the electromagnetic holding magnet in a simplified perspective representation, wherein the retaining plate and the magnetic coil are not shown.

FIG. 3 shows the electromagnetic holding magnet 2 in a simplified perspective representation, wherein the retaining plate 4 and the magnetic coil 18 were not shown. In addition, the electromagnetic holding magnet 2 is depicted from the rear which is not visible in FIG. 2.

It comprises a magnetic bypass 30 that extends between the second end of the first yoke leg 8 and second end 28 of the middle pole 12, as well as between the second end of the second yoke leg 10 and the second end 28 of the middle pole 12. In FIG. 3, the second end 28 of the middle pole is not visible since the magnetic bypass 30 is designed in the shape of a U and encompasses the second end 28 of the middle pole 12 (see FIG. 5). Like the first yoke leg 8, the second yoke leg 10 and the middle pole 12, the magnetic bypass 30 is manufactured from flat parts. For this purpose, pre-annealed corrosion-resistant and stainless sheet metal parts are also preferably used.

The magnetic bypass 30 is securely connected to the second end 28 of the middle pole 12, for example pressed onto it. A first air gap 32 is between the second end of the first yoke leg 8 and a first end face of the bypass 30 that faces it. A second air gap 34 is between the second end of the second yoke leg 10 and a second end face of the bypass 30 that faces it. The air gap 32, 34 ensures that the magnetic retaining flux generated by the permanent magnets 14, 16 are not easily deflected into the bypass 30. If the magnetic coil 18 is not energized, the air gap 32, 34 ensures that the magnetic retaining flux flows as described above and is not deflected into the bypass 30.

According to another exemplary embodiment, the air gap is provided between the second end 28 of the middle pole 12 and the bypass 30 in contrast to the depiction in FIG. 3. The bypass 30 in this case directly abuts the first and second yoke legs 8, 10 and is also preferably attached there.

Figure 4:
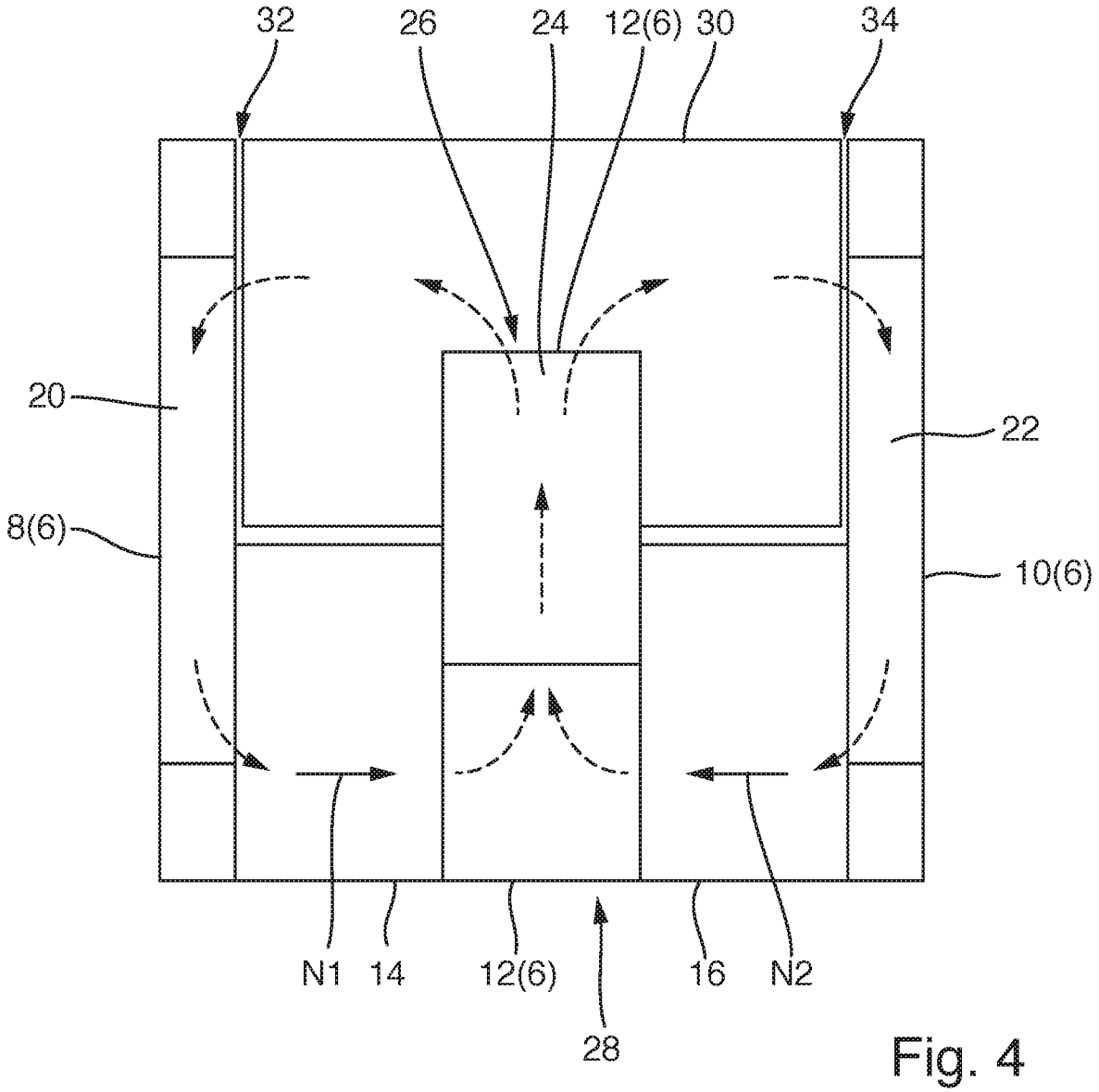
FIG. 4 shows the electromagnetic holding magnet from FIG. 3 in a plan view.

FIG. 4 shows the electromagnetic holding magnet 2 in a plan view, wherein the retaining plate 4 and the magnetic coil 18 are not shown. The depiction in FIG. 4 corresponds to the orientation in FIGS. 1 and 2. In contrast to the depiction in FIG. 3, the permanent magnets 14, 16 are again depicted at the front (bottom). The magnetic flux is indicated by dashed arrows as it flows through the bypass 30 and through the air gaps 32, 34 be-tween the permanent magnets 14, 16, the yoke legs 8, 10 and the middle pole 12 when the magnetic coil 18 is energized. The magnetic flux is forced into the bottom region of the yoke 6 and no longer passes through the middle pole 12 in the direction of the retaining plate 4.

Figure 5:
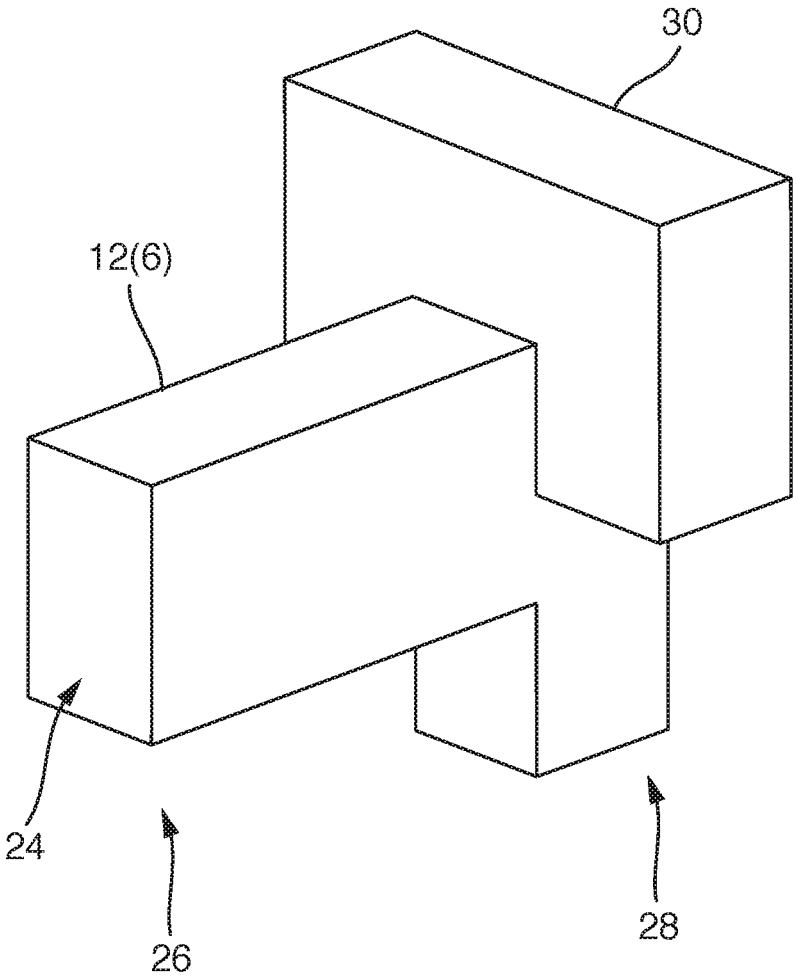
FIG. 5 shows a middle pole with a mounted magnetic bypass of the electromagnetic holding magnet in a schematically simplified perspective representation.

In a schematically simplified perspective representation, FIG. 5 shows the middle pole 12 and the U-shaped magnetic bypass 30 attached thereto.

In a method to manufacture an electromagnetic holding magnet 2 as explained above with reference to FIG. 1 to 5, the following steps are for example carried out.

Flat parts are arranged for manufacturing the yoke 6, i.e., in particular the first yoke leg 8, the second yoke leg 10 and the middle pole 12. The flat parts that were previously stamped from a pre-annealed, corrosion-resistant or stainless sheet metal are connected to each other. Likewise, the flat parts are first arranged in the shape of the yoke 6 and then connected. Moreover, the magnetic coil 18 is arranged so that it at least partially surrounds the middle pole 12. The yoke legs 8, 10 that each conduct a partial flux of the magnetic retaining flux are arranged symmetrically relative to the middle pole 12 and the magnetic coil 18 that at least partially surrounds it. It is also provided that first the yoke legs 8, 10 and the middle pole 12 as well as the magnetic coil 18 and the permanent magnets 14, 16 are arranged, and then these components are secured.

The first end face 20 of the first yoke leg 8, the second end face 22 of the second yoke leg 10 and the central end face 24 of the middle pole 12 are then e.g. polished smooth together in order to establish a necessary flatness. A completely flat contact surface for the retaining plate 4 is provided. It is also provided that the bypass 30 is manufactured from flat parts. This is for example pressed onto the middle pole 12 in the region of its second end 28. Then the middle pole 12 together with the two yoke legs 8, 10 and the permanent magnets 14, 16 as well as the magnetic coil 18 can be fixed, e.g. cast.

It is also provided for the polished flat parts to first be positioned and then secured, e.g. cast. A surface coating can be applied to the polished surfaces.

All named features, including those taken from the drawings alone and individual features, which are disclosed in combination with other features, are considered alone and in combination as essential for the invention. Embodiments according to the invention can be fulfilled through individual features or a combination of several features. In the context of the invention, features which are designated with "in particular" or "preferably" are to be understood as optional features.

REFERENCE NUMBER LIST

2 Electromagnetic holding magnet
4 Retaining plate

6 Yoke
8 First yoke leg
10 Second yoke leg
12 Middle pole
14 First permanent magnet
16 Second permanent magnet
18 Magnetic coil
20 First end face
22 Second end face
24 Central end face
26 First end
28 Second end
30 Bypass
32 First air gap
34 Second air gap
N1 North-south direction of the first permanent magnet
N2 North-south direction of the second permanent magnet

What is claimed is:

1. An electromagnetic holding magnet comprising a yoke, a retaining plate interacting with the yoke as an anchor, first and second permanent magnets and a magnetic coil that encloses the yoke in sections, wherein in an energized state, the magnetic coil is configured to at least reduce a magnetic retaining flux generated by the first and second permanent magnets in the yoke and the retaining plate in order to at least reduce or eliminate a retaining force generated by the first and second permanent magnets and release the retaining plate, wherein the yoke comprises a first yoke leg, a second yoke leg and a middle pole, wherein the yoke legs each conduct a partial flow of the magnetic retaining flux and are arranged symmetrically in relation to the middle pole and the magnetic coil that at least partially surrounds it, and wherein:

a) the first and second yoke leg are flat, wherein the middle pole is arranged centrally between the first yoke leg and the second yoke leg, the first yoke leg, the second yoke leg and the middle pole each comprise a first and opposing second end, and a first end face comprised by the first end of the first yoke leg, a second end face comprised by the first end of the second yoke leg, and a central end face comprised by the first end of the middle pole jointly form a contact surface for the retaining plate, b) the magnetic coil surrounds the middle pole between its first end and its second end in sections, and c) the first permanent magnet is arranged between the second end of the first yoke leg and the second end of the middle pole, and the second permanent magnet is arranged between the second end of the second yoke leg and the second end of the middle pole.

2. The electromagnetic holding magnet according to claim 1, wherein the first yoke leg, the second yoke leg, the middle pole and the retaining plate consist of flat parts formed of pre-annealed, corrosion-resistant or stainless sheet metal.

3. The electromagnetic holding magnet according to claim 2, further comprising a magnetic bypass that extends between the second end of the first yoke leg and second end of the middle pole, and between the second end of the second yoke leg and the second end of the middle pole.

4. The electromagnetic holding magnet according to claim 2, wherein the first end face of the first yoke leg, the second end face of the second yoke leg and the central end face of the middle pole are polished surfaces.

5. The electromagnetic holding magnet according to claim 3, wherein the magnetic bypass is securely connected to the second end of the middle pole, and a first air gap is provided between the second end of the first yoke leg and a first end face of the bypass facing the second end of the first yoke leg, and a second air gap is provided between the second end of the second yoke leg and a second end face of the bypass facing the second end of the second yoke leg.

6. The electromagnetic holding magnet according to claim 1, wherein the first permanent magnet and the second permanent magnet are oppositely polarized.

7. An electromagnetic locking element comprising a base element, an opening element that is movable relative to the base element and an electromagnetic holding magnet according to claim 1, wherein the base body comprises the yoke, the first and second permanent magnets and the magnetic coil, and the opening body comprises the retaining plate, wherein in an energized state, the magnetic coil is configured to at least reduce a magnetic retaining flux generated by the first and second permanent magnets in the yoke and the retaining plate in order to at least reduce or eliminate a retaining force generated by the first and second permanent magnets and release the retaining plate.

8. A method for manufacturing an electromagnetic holding magnet that includes a yoke, a retaining plate that interacts with the yoke as an anchor, first and second permanent magnets, and a magnetic coil that encloses the yoke in sections and, in an energized state, is configured to at least reduce a magnetic retaining flux generated by the first and second permanent magnets in the yoke and the retaining plate in order to at least reduce or eliminate a retaining force generated by the first and second permanent magnets and release the retaining plate, said method comprising:

arranging flat parts to manufacture the yoke with a first yoke leg, a second yoke leg, and a middle pole; and arranging the magnetic coil such that it at least partially surrounds the middle pole;

wherein the yoke legs each conduct a partial flux of the magnetic retaining flux and are arranged symmetrically relative to the middle pole and the magnetic coil that at least partially surround it, and wherein:

a) the first and second yoke leg are flat, wherein the middle pole is arranged centrally between the first yoke leg and the second yoke leg, the first yoke leg, the second yoke leg and the middle pole each comprise a first and opposing second end, and a first end face comprised by the first end of the first yoke leg, a second end face comprised by the first end of the second yoke leg, and a central end face comprised by the first end of the middle pole jointly form a contact surface for the retaining plate, b) the magnetic coil surrounds the middle pole between its first end and its second end in sections, and c) the first permanent magnet is arranged between the second end of the first yoke leg and the second end of the middle pole, and the second permanent magnet is arranged between the second end of the second yoke leg and the second end of the middle pole.

9. The method according to claim 8, wherein the flat parts are manufactured by stamping from a pre-annealed, corrosion-resistant or stainless sheet metal before they are arranged.

10. The method according to claim 9, wherein the flat parts are manufactured by stamping before they are arranged.

11. The method according to claim 9, wherein the flat parts are arranged and fixed to manufacture a magnetic bypass, wherein the magnetic bypass is arranged between the second end of the first yoke leg and the second end of the middle pole, and between the second end of the second yoke leg and the second end of the middle pole, wherein the magnetic bypass is securely connected to the second end of the middle pole, wherein a first air gap is provided between the second end of the first yoke leg and a first end face of the bypass facing the second end of the first yoke leg, and wherein a second air gap is provided between the second end of the second yoke leg and a second end face of the bypass facing the second end of the second yoke leg.

12. The method according to claim 8, wherein the method comprises:

a) arranging flat parts to manufacture the first flat yoke leg, b) arranging flat parts to manufacture the second flat yoke leg, c) arranging flat parts to manufacture the middle pole, d) arranging the middle pole centrally between the first yoke leg and second yoke leg such that the first end face comprised by the first end of the first yoke leg, the second end face comprised by the first end of the second yoke leg, and the central end face comprised by the first end of the middle pole jointly form the contact surface for the retaining plate, e) securing the yoke legs and middle pole, f) arranging the first permanent magnet between the second end of the first yoke leg and the second end of the middle pole, and arranging the second permanent magnet between the second end of the second yoke leg and the second end of the middle pole, and g) arranging the magnetic coil on the middle pole between its first end and second end so that the magnetic coil surrounds the middle pole in sections.

13. The method according to claim 12, wherein the first end face, the second end face and the central end face are polished smooth to provide a flat contact surface for the retaining plate.

* * * * *